US010770045B1

(12) United States Patent
Barram et al.

(10) Patent No.: US 10,770,045 B1
(45) Date of Patent: Sep. 8, 2020

(54) REAL-TIME AUDIO SIGNAL TOPOLOGY VISUALIZATION

(71) Applicant: Avid Technology, Inc., Burlington, MA (US)

(72) Inventors: Edward Barram, Walnut Creek, CA (US); Peter M. Bouton, Kentfield, CA (US)

(73) Assignee: Avid Technology, Inc., Burlington, MA (US)

( * ) Notice: Subject to any disclaimer, the term of this patent is extended or adjusted under 35 U.S.C. 154(b) by 0 days.

(21) Appl. No.: 16/517,877

(22) Filed: Jul. 22, 2019

(51) Int. Cl.
*G10H 1/00* (2006.01)
*H04H 60/04* (2008.01)

(52) U.S. Cl.
CPC ..... *G10H 1/0008* (2013.01); *H04H 60/04* (2013.01); *G10H 2220/116* (2013.01)

(58) Field of Classification Search
CPC .. G10H 1/0025; G10H 1/0008; G10H 1/0066; G10H 2210/125; G10H 2220/126; G10H 2220/106; G10H 1/0033; G10H 1/0058; G10H 2240/325; G10H 2220/101; G10H 2240/175; G10H 2220/116; G10H 2220/111; G10H 2210/105; G10H 2240/016; G10H 1/361; G10H 1/365; G10H 2210/021; G10H 2220/091; G10H 2210/101; G10H 2210/111; G10H 2250/311; G10H 2210/356; G10H 2220/121; G11B 20/10; G10G 1/00
See application file for complete search history.

(56) References Cited

U.S. PATENT DOCUMENTS 6,664,966 B1 12/2003 Ibrihim et al.
7,669,129 B2 2/2010 Mathur
9,390,696 B2 * 7/2016 Kiely ..... H04H 60/04
(Continued)

FOREIGN PATENT DOCUMENTS

WO WO 01/1167 2/2001

OTHER PUBLICATIONS

Autodesk Unveils a New Smoke, Debra Kaufman, Creative Cow. Net, 10 pages, NAB 2012, Apr. 2012.
(Continued)

*Primary Examiner* — Marlon T Fletcher
(74) *Attorney, Agent, or Firm* — Oliver Strimpel

(57) ABSTRACT

A user interface for a digital audio workstation provides an overview of the audio signal routing of an audio composition in the form of a node graph. The node graph updates in real time as an audio session is edited. The representation of the nodes on the graph indicates the node type, such as audio input or track, mixer, plug-in, and output, as well as the processing resources assigned to each node. The node graph includes one or more nodes representing submixes that may be adjusted using a mixer channel independently of other submixes or outputs of the audio session. The representation of audio signal flow between the nodes in the graph distinguishes between insert routing and auxiliary sends. The user interface may be used interactively to edit the audio composition by providing a toolbox for creating new nodes and commands for specifying audio signal connections between nodes.

24 Claims, 4 Drawing Sheets

(56) References Cited

U.S. PATENT DOCUMENTS

2002/0121181 A1* 9/2002 Fay ..... G10H 1/0066 84/609
2002/0124715 A1* 9/2002 Fay ..... G10H 1/0066 84/645
2006/0210097 A1* 9/2006 Yerrace ..... G06F 3/165 381/119
2010/0307321 A1* 12/2010 Mann ..... G10H 1/0025 84/613
2011/0011243 A1* 1/2011 Homburg ..... G10H 1/40 84/612
2011/0011244 A1* 1/2011 Homburg ..... G10H 7/04 84/612
2012/0297958 A1* 11/2012 Rassool ..... G10H 1/0025 84/609
2013/0025437 A1* 1/2013 Serletic ..... G10H 1/0025 84/634
2014/0053710 A1* 2/2014 Serletic, II ..... G10H 1/383 84/609
2014/0053711 A1* 2/2014 Serletic, II ..... G06F 3/0481 84/611
2014/0064519 A1* 3/2014 Silfvast ..... H04H 60/04 381/119
2015/0063602 A1* 3/2015 Radford ..... G06F 3/165 381/119
2016/0163297 A1* 6/2016 Trebard ..... G10H 1/0025 84/610
2019/0287502 A1* 9/2019 Kiely ..... G10H 1/38

OTHER PUBLICATIONS

Avid DS Nitris User Guides Version 8.4, Avid Technology, Inc., Chapter 2, Folded Nodes, pp. 1186-1187, Jun. 2007.

Evertz 3080IPX-10G Product Brochure, Evertz Technologies Limited, https://evertz.com/products/3080IPX-10G, 5 pages, Apr. 11, 2016.

* cited by examiner

REAL-TIME AUDIO SIGNAL TOPOLOGY VISUALIZATION

BACKGROUND

Media compositions are created using media composition tools, such as digital audio workstations (DAWs) and non-linear video editors. These tools enable users to input multiple sources and to combine them in flexible ways to produce the desired result. Audio compositions, in particular, often involve more than 50 tracks and submixes, with movie soundtracks commonly including as many as 500 tracks. These are processed and combined using complex audio signal routing paths. While DAWs provide a user interface designed to enable users to configure their desired signal routing on a track by track basis, the views they provide of the current status of the editing session (e.g., "edit window" or "mix window") do little to assist the user in visualizing the overall signal network and the routing topology of their session, especially for complex sessions with multiple submixes and plug-ins, and large numbers of input channels. There is a need to provide a user interface that helps the user visualize the audio signal topology of their entire editing session in real-time.

SUMMARY

A node graph helps users visualize the signal routing in an audio session being edited with a digital audio workstation. The node graph may be implemented as an interactive interface that enables a user to edit the audio connections within an editing session as an alternative to using other interfaces such as edit and mix windows.

In general, in one aspect, a user interface for visualizing an audio composition on a digital audio workstation application comprises: a node graph representing an audio signal routing of the audio composition, wherein: the node graph includes a first node representing a first independent submix; the first independent submix is mapped to a first channel of a mixer that enables the user to adjust the first independent submix; and the node graph is updated in real-time when the audio signal routing of the audio composition is changed.

Various embodiments include one or more of the following features. The mixer is implemented on digital signal processing hardware in data communication with a system hosting the digital audio workstation application. The mixer is implemented in software on a system hosting the digital audio workstation application. The mixer is displayed as a window within the user interface of the digital audio workstation. The first independent submix is mapped to the first channel by a user of the digital audio workstation application. The node graph includes a second node representing a second independent submix; an output of the first independent submix is routed to the second independent submix; the second independent submix is mapped by the user to a second channel of the mixer; and the user is able to adjust the second channel of the mixer to adjust the second independent submix. The first independent submix includes adjusting a gain of the first independent submix. Adjusting the first independent submix includes applying a software plug-in module to process the first independent submix. Adjusting the first independent submix includes panning the first independent submix. Adjusting the first independent submix includes at least one of adjusting an equalization and dynamics processing. The node graph further includes one or more nodes representing audio inputs and one or more nodes representing plug-in audio processing modules. The first node representing the first independent submix is represented with a first representation type on the node graph; the one or more nodes representing the audio inputs are represented with a second representation type on the node graph; the one or more nodes representing plug-in audio processing modules are represented with a third representation type on the node graph; and each of the first, second, and third representations types are different from each other. A representation of a node of the node graph includes an indication of a processing resource to which the node is assigned. The processing resource is a digital signal processing resource in data communication with a system hosting the digital audio workstation application. The processing resource is a processor of a system hosting the digital audio workstation application. The user interface further comprises an edit window that displays a table that includes an entry for each of: a plurality of audio inputs to the audio composition; and one or more submixes of the audio composition; and wherein the user is able to interact with the table to specify: a plug-in for the entry; an auxiliary send for the entry; and an output for the entry. The user interface further comprises a mix window that displays a representation of a plurality of channels of a mixer including a representation of the first channel; each of a plurality of audio inputs and one or more submixes of the audio composition is mapped to a different channel of the mixer; and the user is able to interact with the mix window to adjust parameters of each of the plurality of audio inputs and the one or more submixes.

In general, in another aspect, a method of mixing a plurality of audio inputs to create an audio composition comprises: enabling a user of a digital audio workstation application to: route a subset of the plurality of audio inputs to a submix; map the submix to a channel of a mixer, wherein controls of the channel of the mixer enable the user to adjust the submix; and on a graphical user interface of the digital audio workstation application, displaying in real-time a graph representation of a signal routing of the audio composition, wherein the graph representation includes a node representing a submix that is mapped to a channel of a mixer.

Various embodiments include one or more of the following features. Adjusting the submix includes at least one of adjusting a gain of the submix, adjusting a pan of the submix, and processing the submix with plug-in software module. The mixer is implemented in software on a system that hosts the digital audio workstation application. The mixer is implemented in digital signal processing hardware that is in data communication with a system that hosts the digital audio workstation application. Enabling a user to edit the audio composition by providing: a toolbox of node types for enabling a user to specify a node type and add a new node of the specified node type to the node graph; and a command for creating one or more audio connections on the node graph between the new node and one or more existing nodes of the node graph.

In general, in a further aspect, a computer program product comprises: a non-transitory computer-readable medium with computer program instructions encoded thereon, wherein the computer program instructions, when processed by a computer system, instruct the computer system to provide a user interface for visualizing an audio composition on a digital audio workstation application, the user interface comprising: a node graph representing an audio signal routing of the audio composition, wherein: the node graph includes a first node representing a first independent submix; the first independent submix is mapped to a first channel of a mixer that enables the user to adjust the first independent submix; and the node graph is updated in real-time when the audio signal routing of the audio composition is changed.

In general, in yet another aspect, a system comprises: a memory for storing computer-readable instructions; and a processor connected to the memory, wherein the processor, when executing the computer-readable instructions, causes the system to display a user interface for visualizing an audio composition on a digital audio workstation application, the user interface comprising: a node graph representing an audio signal routing of the audio composition, wherein: the node graph includes a first node representing a first independent submix; the first independent submix is mapped to a first channel of a mixer that enables the user to adjust the first independent submix; and the node graph is updated in real-time when the audio signal routing of the audio composition is changed.

DETAILED DESCRIPTION

Figure 1:
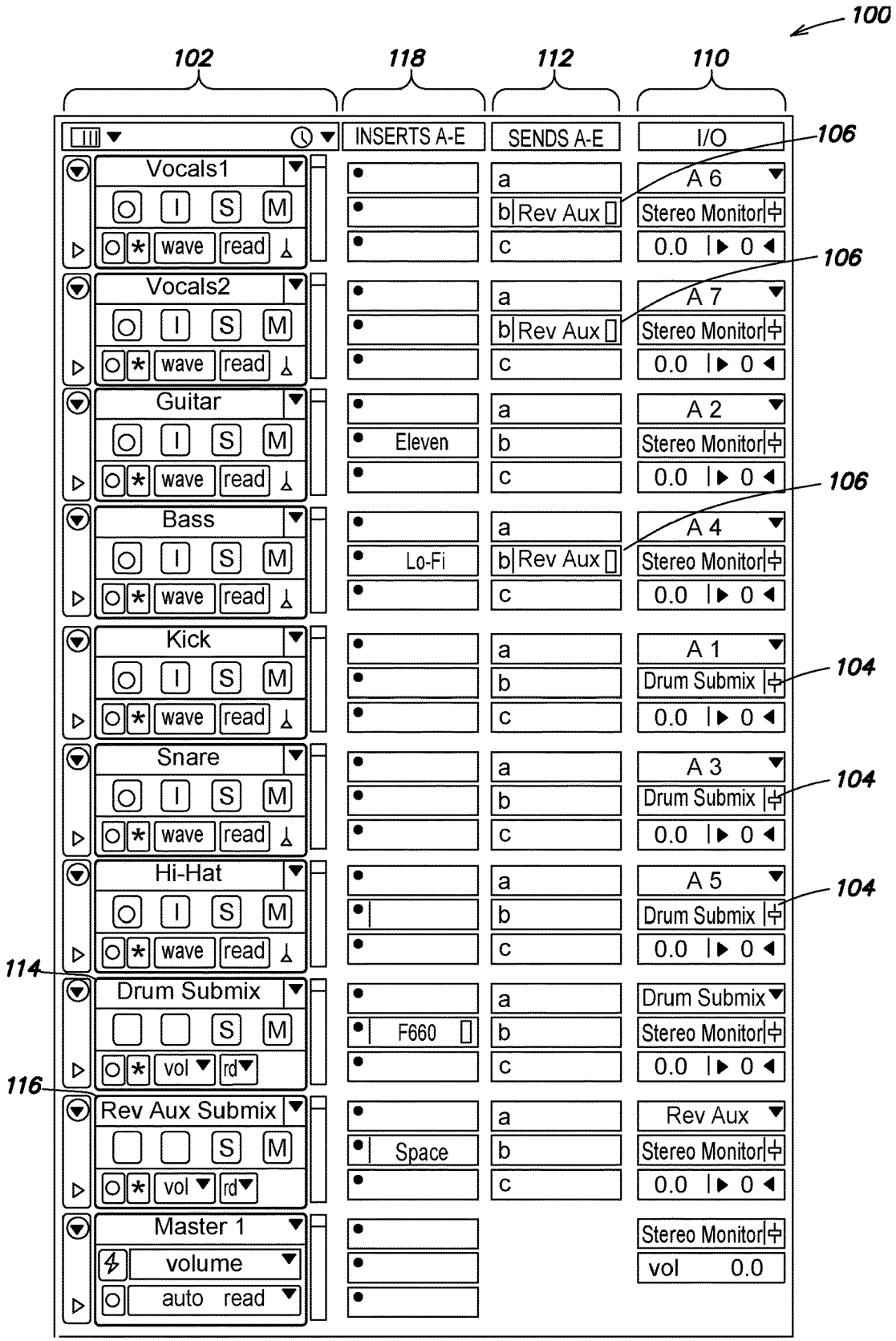
FIG. 1 (Prior Art)
FIG. 1 illustrates a screen shot of a portion of an edit window of a user interface of a prior art digital audio workstation while editing an audio composition.

Digital media compositions are created using computer-based media editing tools tailored to the type of composition being created. Video compositions are generally edited using non-linear video editing systems, such as Media Composer® from Avid® Technology, Inc. of Burlington, Mass., and audio compositions are created using DAWs, such as Pro Tools®, also from Avid Technology, Inc. These tools are typically implemented as applications hosted by computing systems. The hosting systems may be local to the user, such as a user's personal computer or workstation or a networked system co-located with the user. Alternatively, applications may be hosted on remote servers or be implemented as cloud services. While the methods and systems described herein apply to both video and audio compositions, the description focuses on the audio domain.

DAWs provide users with the ability to record audio, edit audio, route and mix audio, apply audio effects, automate audio effects and audio parameter settings, work with MIDI data, play instruments with MIDI data, and create audio tracks for video compositions. They enable editors to use multiple sources as inputs to a composition, which are combined in accordance with an editor's wishes to create the desired end product. To assist users in this task, composition tools provide a user interface that includes a number of windows, each tailored to the task being performed. The main windows used for editing audio compositions are commonly referred to the edit window and the mix windows. These provide different views of the audio editing session and mediate the editing process, including enabling users to specify the inputs and outputs for each channel being edited into a composition, i.e., the signal routing of the channel, as well as apply processing to the channel. The processing may include the application of an audio effect, which may be performed by a module built in to the DAW or by a third-party plug-in module. The effect may be executed natively on the DAW host or run on special-purpose hardware. The special purpose hardware may be included within the host or may comprise a card or other module connected to the host. Such special purpose hardware typically includes a digital signal processor (DSP), which may be used both to perform the processing required by plug-in modules as well as to perform the mixing required to render the audio deliverable (e.g., stereo or 5.1). In a common use case, audio effects are implemented as plug-in software modules. The edit window also enables the user to direct a subset of the inputs to a submix. The submix can then be defined as a channel of its own and can itself be processed and routed in a manner similar to that afforded to a source input channel. This is achieved by mapping the submix to a channel of a mixer. The edit window facilitates the setting up of the input channels, their effects processing, and their routing on a channel by channel basis. Neither the edit window nor the mix window provides a direct view of the signal routing within the audio composition.

In the context of audio editing using a DAW, the terms "track" and "channel" are used interchangeably. A track is one of the main entities in an audio mixing environment. A track consists of an input source, an output destination, and a collection of plugins. The input is routed through the plugins, then to the output. A track also has "sends" which allow the input to be routed to any other arbitrary output. The sends are "post plugins," i.e., the audio signal is processed through the plugins before being sent to the send destination. A track also has a set of controls that allow the user to adjust the volume of the incoming signal, as well as the ability to "pan" the output signal to the final output destination. In the context of audio mixing using a mixer, either implemented in software or in special purpose hardware, the term "channel" refers to a portion of the mixer allocated to a particular audio entity, such as audio input source or a submix. In this context, the channel refers to the set of mixing controls used to set and adjust parameters for the audio entity, which includes at least a gain control, as well as most commonly controls for equalization, compression, pan, solo, and mute. For software mixing, these controls are commonly implemented as graphical representations of physical controls such as faders, knobs, buttons, and switches. For hardware mixing, the controls are implemented as a combination of physical controls (faders, knobs, switches, etc.) and touchscreen controls.

FIG. 1 is a high-level illustration of a portion of an edit window 100 of a DAW for a simple audio project. The timeline portion of the edit window has been omitted. Each of the tracks is specified by an entry in track listing 102. The figure illustrates a session having seven audio input tracks: vocals 1, vocals 2, guitar, bass, kick drum, snare drum, and hi-hat. Two submixes are also defined—drum submix 104 and reverb aux submix 106. Drum submix 104 has three inputs: kick drum, snare drum, and hi-hat, as shown in I/O listing 110. The reverb aux submix also has three inputs—vocals 1, vocals 2, and bass, and is named as such since it refers to a set of sources to which a reverb effect is to be applied. For this submix, the user has defined the submix to be in parallel with the audio sources' main output, which goes directly to a stereo monitor for final mixing for stereo output (shown in I/O listing 110). The second output from the three sources which are routed to the reverb effect submix is created as an auxiliary send and is defined in sends column 112. Each of the submixes is defined as a track of its own and is given a corresponding entry in track listing 102:

drum submix track 114 and reverb aux submix track 116. The user is able to map each of the submixes to its own independent mixer channel using the edit window or the mix window (described next). The edit window also enables the user to apply processing effects to individual tracks. For the session illustrated in edit window 100, the user has applied the Eleven and Lo-Fi effects to the guitar and bass respectively, as shown in inserts column 118. The user is also able to apply an effect to the submixes, as shown in the Figure: F660, a dynamic range compressor effect for the drum submix and Space, a reverb effect, for the reverb aux submix.

Figure 2:
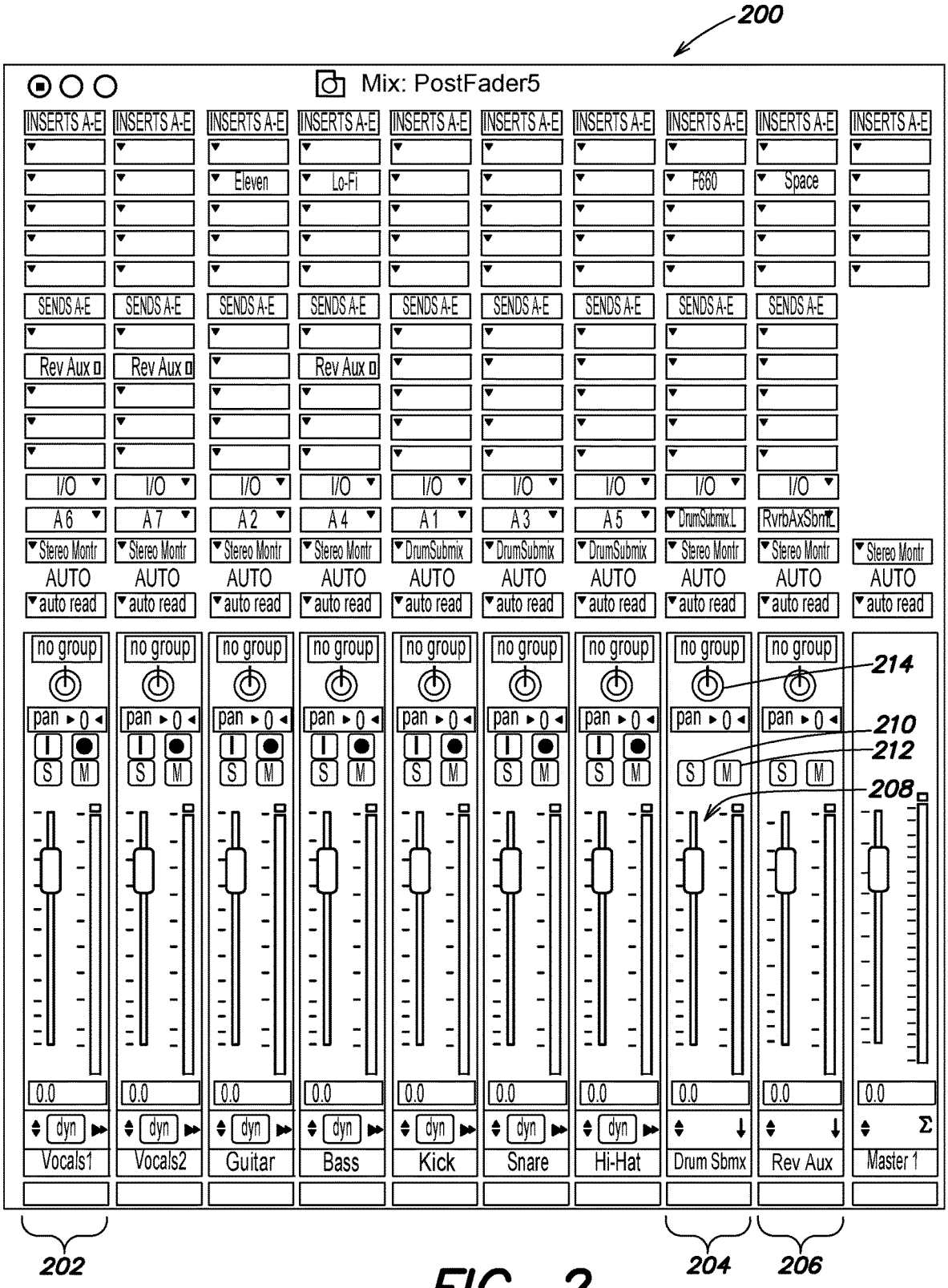
FIG. 2 (Prior Art)
FIG. 2 illustrates a screen shot of a mix window of a user interface of a prior art digital audio workstation while editing the audio composition of FIG. 1.

DAW mix window 200 corresponding to the session shown in the edit window of FIG. 1 is illustrated in FIG. 2. Each of the seven audio inputs are assigned to an independent mixer channel (e.g., the vocals 1 input is assigned to channel 202). In addition, each of the submixes are mapped to an independent mixer channel: drum submix 104 to channel 204, and reverb aux submix 106 to channel 206. The various controls of the independent mixer channels can be used to adjust submix parameters before the submix signal is routed to its output, which, for the illustrated session, is a stereo monitor for mixing a two-channel stereo output, as indicated in the input/output labels shown in both the edit window and the mix window. In the mix window screenshot illustrated in FIG. 2, such controls include, for channel 204 assigned to the drum submix, fader 208 (generally used to control gain), solo button 210, mute button 212, and pan control knob 214.

The views that existing DAW user interfaces provide of the editing session, such as edit window (FIG. 1) and mix window (FIG. 2), are principally designed to enable users to edit audio as well as to define routing and effects processing for individual tracks and submixes within a given audio editing session. For those who prefer the traditional mixer interface, the mix window provides a familiar mixing console interface for facilitating the mixing process, including the ability to control parameters of each of the tracks and submixes. Both windows have indicators on each track or channel that specify routing and effects processing. However, neither window provides a direct view of the signal flow in an audio editing session. When editing sessions with large numbers of tracks, submixes, and audio effects it becomes difficult to infer the session's overall signal routing and effects processing. This problem becomes especially acute when users receive large sessions from other users and are not familiar with the way in which they were constructed.

Figure 3:
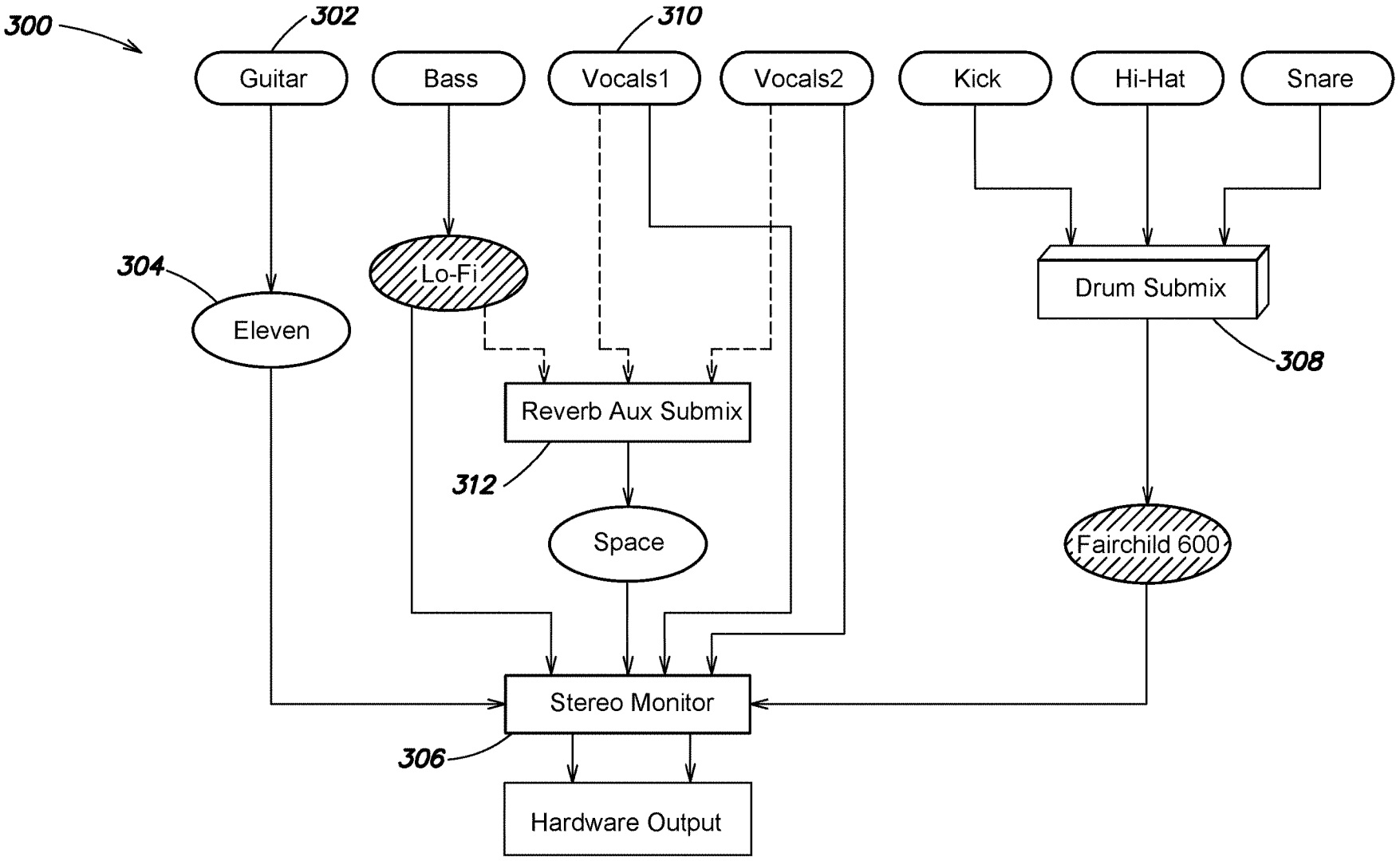
FIG. 3 illustrates a signal node graph view of the audio composition shown in the editing session of FIGS. 1 and 2.

This deficiency is addressed with a graphical node graph of the signal routing and processing. FIG. 3 shows a signal node graph corresponding to the session illustrated in FIGS. 1 and 2. The graph provides a ready overview of the signal pathways and effects processing. The graph is updated in real-time or near-real-time to reflect routing changes performed using the edit window or other user interfaces of a DAW. The signal node graph may be a selectable window forming a part of the graphical user interface of a DAW. The graph may also be displayed on a display of an audio control surface in data communication with a DAW. An example of an audio control surface is described in U.S. Pat. No. 10,191,607 entitled "Modular Audio Control Surface," which is incorporated herein by reference. In the signal node graph, each node is a part of the signal network of the audio composition being edited.

Nodes may be one of various different types including: audio input nodes, effects processing (e.g., plug-in module) nodes, submix nodes, and hardware output nodes. The representation of a node in the signal node graph may include an aspect that indicates the type of the node. In the example illustrated in FIG. 3, audio inputs are shown as rounded rectangles, effects processing modules are shown as ellipses, and mixers as rectangles. The node representation within the graph may further indicate the processing resource type allocated to the node. In the illustrated example, effects processing nodes "Lo-Fi" (distortion effects) and "Fairchild 660" (vintage compressor) implemented on special purpose hardware, such as a digital signal processor (DSP), are shaded. The remaining (not shaded) effects processing nodes "Eleven" (guitar effects processor) and "Space" (reverb effects) are implemented in software on the platform hosting the DAW. Similarly, a mixer node implemented in special purpose hardware is indicated as a three-dimensional box (e.g., "Drum Submix" in FIG. 3), while other submixes shown as two-dimensional rectangles ("Reverb Aux Submix" and "Stereo Monitor") are implemented in software on the DAW host platform.

Signal node graph 300 represents audio inputs as leaf nodes, as shown at the top of FIG. 3. Arrows connecting the nodes indicate signal routing. For example, guitar input 302 is routed through Eleven effects processor 304, which in turn sends the processed signal to stereo monitor 306. The three drum instruments are each routed to drum submix 308, which sends its output to effects processing module Fairchild 660. After effects processing, the drum submix is sent to stereo monitor 306 for mixing down to two channel (stereo) output. Drum submix 308 is mapped to channel 204 on mixer 200, which may be used to adjust its parameters, such as gain, pan, EQ, etc. If the submix has multiple inputs and/or multiple outputs, the gain for each such input or output may be separately controlled via the mixer channel to which the submix is assigned. The mapping of drum submix 308 to a channel of a mixer is under the user's control. There is no constraint that a particular submix needs to be routed to any particular downstream effects processor or mixer channel. In some systems, the various resources connected to the DAW are discovered automatically, and the DAW host system may automatically allocate resources to perform the mixing functions. This may be done in accordance with pre-specified system preferences, and/or to minimize latency. As discussed above, the type of mixer resources on which the mixing is performed (e.g., special-purpose hardware or in software running natively on the host) may be indicated in the signal graph by a node shape, color, shading, or text corresponding to the allocated mixer resource type.

The signal node graph also represents auxiliary sends, which may be distinguished from insert routing using graphics or text. In the node graph illustrated, insert routing is shown by solid arrows and sends are shown by dashed line arrows. For example, the main output of vocals 1 310 is routed to stereo monitor 306 (solid arrow), while the auxiliary send is directed to reverb aux submix 312 (dashed arrow). Similarly, the bass, after processing by the Lo-Fi effect is routed both to stereo monitor 306 (solid arrow, main output) as well as to reverb aux submix 312 (dashed arrow, auxiliary send).

Figure 4:
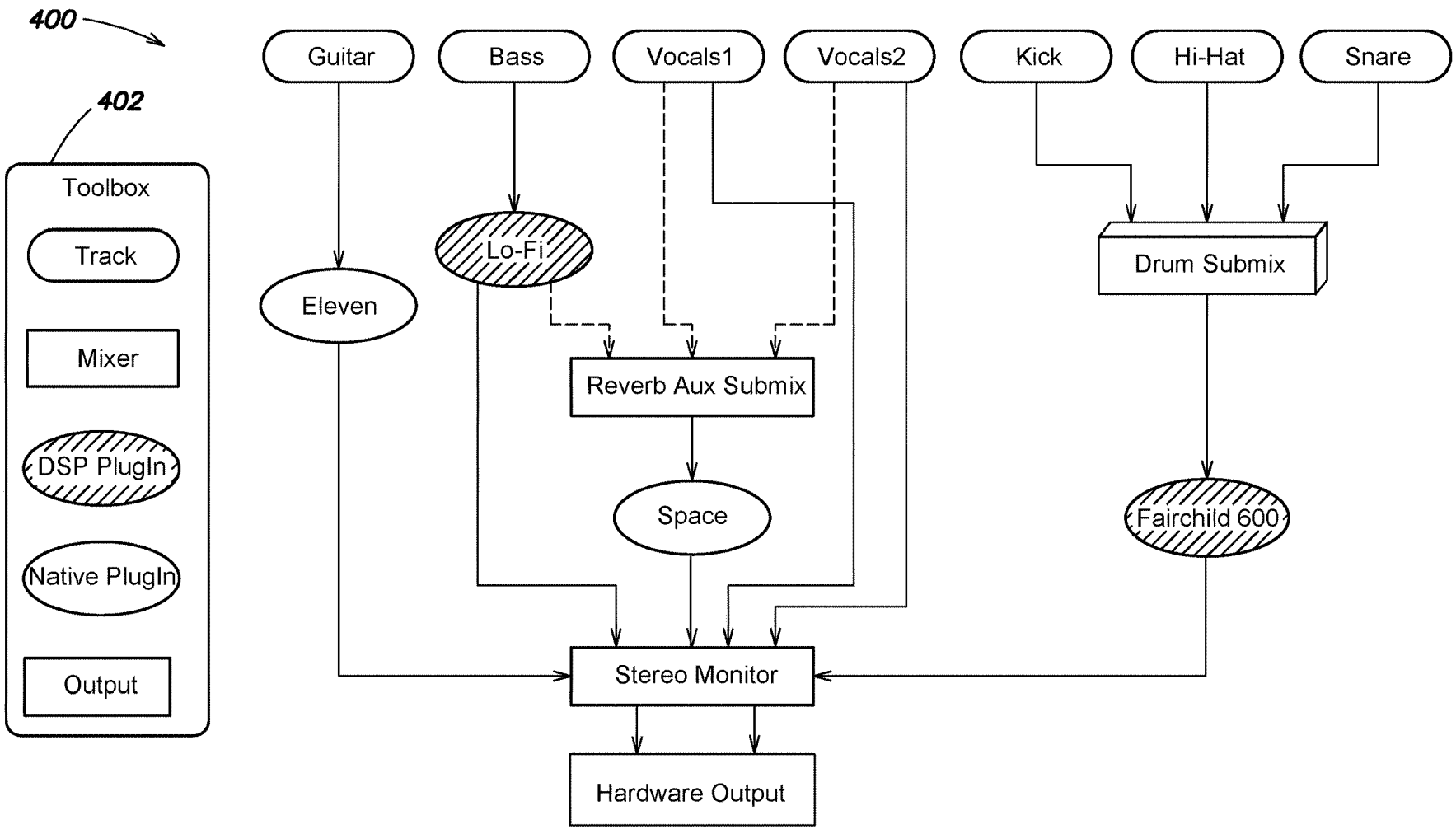
FIG. 4 illustrates an interactive signal node graph interface for editing an audio composition.

The signal node graph may be implemented as an interactive interface that enables a user to edit the audio connections within an editing session on a DAW as an alternative to using other interfaces of the DAW, such as the edit and mix windows. Interactive node graph interface 400 is illustrated in FIG. 4. A user is able to select a node type from toolbox 402 to create a new instance of that node type, and to insert it (e.g., by dragging and dropping) onto a signal node graph representation of a session, referred to herein as a canvas. Available nodes appearing within the toolbox may include a track, mixer, DSP plugin, native plugin, and output. The user may select from a variety of options for each new node, e.g., from a pop-up menu. For example, DSP plugin node options include a listing of the various DSP plugins available to the user. The options for a track node include the available types of tracks.

The user is able to connect nodes appearing on the canvas. This may be implemented by enabling a right-click on a node, which provides a connector arrow that the user manipulates to create a link between two nodes, e.g., by clicking and dragging. The interface provides an indication as to whether a connection input by the user is valid based on the type of the source and target nodes. In some implementations, when the user drags the tip of a connector arrow over a target node, the target node indicates whether or not it is a valid connection, e.g., by turning green for a valid connection or red for an invalid connection. When the user connects a track or other node to a valid destination (e.g., by releasing the mouse when the link is over a valid target node), the system enables the user to choose what type of output they would like to use for the connection. This may be implemented via a pop-up menu listing a set of possible outputs including the "main" output and multiple, e.g., 10, auxiliary send outputs, with the main output being the default selection in the pop-up menu since it is the most commonly used node output. Once a new connection is made, it is indicated as a link arrow similar to those illustrated in FIG. 3, and the connection is added to the current topology in the DAW session. In this manner, a user can create and edit audio connections in a DAW session via an intuitive graphical user interface, such as by dragging nodes onto the canvas and connecting them.

In addition to providing an overview of a session's routing and processing structure, a signal node graph may help editors in various situations that commonly arise during editing. For example, it may help troubleshoot audio routing problems such as when a signal does not appear on a track as expected, or a signal appears on an unexpected track. The editor may use the signal node graph to follow all the connections between the source audio and the destination track to locate the problem. In one implantation, the signal path of an errant signal is highlighted on the graph, using textual or graphical means. The real-time updating of the graph helps editors to visualize and test their troubleshooting theories.

When creating an audio composition, it is usually disadvantageous to deploy both DSP and native effects processing modules on a single track because this may introduce unacceptably high latency in the signal path. However, it can be difficult to identify whether this situation occurs using existing DAW user interfaces such as the edit window and the mix window. The signal node graph clearly shows when this situation occurs as nodes representing native modules are represented differently in the graph from those implemented in a DSP, e.g., with a different shape, shading, or color.

When editors need to determine which sources are feeding a particular mixer, it can be tedious to extract this information from the existing DAW user interface. The graph structure of the signal node graph makes this clear.

The various components of the system described herein may be implemented as a computer program using a general-purpose computer system. Such a computer system typically includes a main unit connected to both an output device that displays information to a user and an input device that receives input from a user. The main unit generally includes a processor connected to a memory system via an interconnection mechanism. The input device and output device also are connected to the processor and memory system via the interconnection mechanism.

One or more output devices may be connected to the computer system. Example output devices include, but are not limited to, liquid crystal displays (LCD), plasma displays, various stereoscopic displays including displays requiring viewer glasses and glasses-free displays, cathode ray tubes, video projection systems and other video output devices, printers, devices for communicating over a low or high bandwidth network, including network interface devices, cable modems, and storage devices such as disk or tape. One or more input devices may be connected to the computer system. Example input devices include, but are not limited to, a keyboard, keypad, track ball, mouse, pen and tablet, touchscreen, camera, communication device, and data input devices. The invention is not limited to the particular input or output devices used in combination with the computer system or to those described herein.

The computer system may be a general-purpose computer system, which is programmable using a computer programming language, a scripting language or even assembly language. The computer system may also be specially programmed, special purpose hardware. In a general-purpose computer system, the processor is typically a commercially available processor. The general-purpose computer also typically has an operating system, which controls the execution of other computer programs and provides scheduling, debugging, input/output control, accounting, compilation, storage assignment, data management and memory management, and communication control and related services. The computer system may be connected to a local network and/or to a wide area network, such as the Internet. The connected network may transfer to and from the computer system program instructions for execution on the computer, media data such as video data, still image data, or audio data, metadata, review and approval information for a media composition, media annotations, and other data.

A memory system typically includes a computer readable medium. The medium may be volatile or nonvolatile, writeable or nonwriteable, and/or rewriteable or not rewriteable. A memory system typically stores data in binary form. Such data may define an application program to be executed by the microprocessor, or information stored on the disk to be processed by the application program. The invention is not limited to a particular memory system. Time-based media may be stored on and input from magnetic, optical, or solid-state drives, which may include an array of local or network attached disks.

A system such as described herein may be implemented in software, hardware, firmware, or a combination of the three. The various elements of the system, either individually or in combination may be implemented as one or more computer program products in which computer program instructions are stored on a non-transitory computer readable medium for execution by a computer or transferred to a computer system via a connected local area or wide area network. Various steps of a process may be performed by a computer executing such computer program instructions. The computer system may be a multiprocessor computer system or may include multiple computers connected over a computer network or may be implemented in the cloud. The components described herein may be separate modules of a computer program, or may be separate computer programs, which may be operable on separate computers. The data produced by these components may be stored in a memory system or transmitted between computer systems by means of various communication media such as carrier signals.

Having now described an example embodiment, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention.

What is claimed is:

1. A user interface for visualizing audio signal routing for an audio composition, the user interface comprising:

within a graphical user interface of a digital audio workstation application displaying a node graph representing an audio signal routing of the audio composition, wherein:

the node graph includes a first node representing a first independent submix;

the first independent submix is mapped to a first channel of a mixer that enables the user to adjust the first independent submix; and the node graph is updated in real-time when the audio signal routing of the audio composition is changed.

2. The user interface of claim 1, wherein the mixer is implemented on digital signal processing hardware in data communication with a system hosting the digital audio workstation application.

3. The user interface of claim 1, wherein the mixer is implemented in software on a system hosting the digital audio workstation application.

4. The user interface of claim 3, wherein the mixer is displayed as a window within the user interface of the digital audio workstation.

5. The user interface of claim 1, wherein the first independent submix is mapped to the first channel by a user of the digital audio workstation application.

6. The user interface of claim 1, wherein:

the node graph includes a second node representing a second independent submix;

an output of the first independent submix is routed to the second independent submix;

the second independent submix is mapped by the user to a second channel of the mixer; and the user is able to adjust the second channel of the mixer to adjust the second independent submix.

7. The user interface of claim 1, wherein adjusting the first independent submix includes adjusting a gain of the first independent submix.

8. The user interface of claim 1, wherein adjusting the first independent submix includes applying a software plug-in module to process the first independent submix.

9. The user interface of claim 1, wherein adjusting the first independent submix includes panning the first independent submix.

10. The user interface of claim 1, wherein adjusting the first independent submix includes at least one of adjusting an equalization and dynamics processing.

11. The user interface of claim 1, wherein the node graph further includes one or more nodes representing audio inputs and one or more nodes representing plug-in audio processing modules.

12. The user interface of claim 11, wherein:

the first node representing the first independent submix is represented with a first representation type on the node graph;

the one or more nodes representing the audio inputs are represented with a second representation type on the node graph;

the one or more nodes representing plug-in audio processing modules are represented with a third representation type on the node graph; and each of the first, second, and third representations types are different from each other.

13. The user interface of claim 11 wherein a representation of a node of the node graph includes an indication of a processing resource to which the node is assigned.

14. The user interface of claim 13, wherein the processing resource is a digital signal processing resource in data communication with a system hosting the digital audio workstation application.

15. The user interface of claim 13, wherein the processing resource is a processor of a system hosting the digital audio workstation application.

16. The user interface of claim 1, wherein the user interface further comprises an edit window that displays a table that includes an entry for each of:

a plurality of audio inputs to the audio composition; and one or more submixes of the audio composition; and wherein the user is able to interact with the table to specify:

a plug-in for the entry;

an auxiliary send for the entry; and an output for the entry.

17. The user interface of claim 1, wherein:

the user interface further comprises a mix window that displays a representation of a plurality of channels of a mixer including a representation of the first channel;

each of a plurality of audio inputs and one or more submixes of the audio composition is mapped to a different channel of the mixer; and the user is able to interact with the mix window to adjust parameters of each of the plurality of audio inputs and the one or more submixes.

18. A method of mixing a plurality of audio inputs to create an audio composition, the method comprising:

enabling a user of a digital audio workstation application to:

route a subset of the plurality of audio inputs to a submix;

map the submix to a channel of a mixer, wherein controls of the channel of the mixer enable the user to adjust the submix; and on a graphical user interface of the digital audio workstation application, displaying in real-time a graph representation of a signal routing of the audio composition, wherein the graph representation includes a node representing a submix that is mapped to a channel of a mixer.

19. The user interface of claim 18, wherein adjusting the submix includes at least one of adjusting a gain of the submix, adjusting a pan of the submix, and processing the submix with plug-in software module.

20. The user interface of claim 18, wherein the mixer is implemented in software on a system that hosts the digital audio workstation application.

21. The user interface of claim 18, wherein the mixer is implemented in digital signal processing hardware that is in data communication with a system that hosts the digital audio workstation application.

22. The user interface of claim 18, further comprising enabling a user to edit the audio composition by providing:

a toolbox of node types for enabling a user to specify a node type and add a new node of the specified node type to the node graph; and a command for creating one or more audio connections on the node graph between the new node and one or more existing nodes of the node graph.

23. A computer program product comprising:

a non-transitory computer-readable medium with computer program instructions encoded thereon, wherein the computer program instructions, when processed by a computer system instruct the computer system to provide a user interface for visualizing audio signal routing for an audio composition, the user interface comprising:

within a graphical user interface of a digital audio workstation application displaying a node graph representing an audio signal routing of the audio composition, wherein:

the node graph includes a first node representing a first independent submix;

the first independent submix is mapped to a first channel of a mixer that enables the user to adjust the first independent submix; and the node graph is updated in real-time when the audio signal routing of the audio composition is changed.

24. A system comprising:

a memory for storing computer-readable instructions; and a processor connected to the memory, wherein the processor, when executing the computer-readable instructions, causes the system to display a user interface for visualizing audio signal routing for an audio composition, the user interface comprising:

within a graphical user interface of a digital audio workstation application displaying a node graph representing an audio signal routing of the audio composition, wherein:

the node graph includes a first node representing a first independent submix;

the first independent submix is mapped to a first channel of a mixer that enables the user to adjust the first independent submix; and the node graph is updated in real-time when the audio signal routing of the audio composition is changed.

* * * * *